US006666621B1

(12) United States Patent
Rutledge

(10) Patent No.: US 6,666,621 B1
(45) Date of Patent: Dec. 23, 2003

(54) TEMPORARY TRENCH COVER AND RAIL

(76) Inventor: James A. Rutledge, 6365 Cavitt Stallman Rd., Granite Bay, CA (US) 95746

( * ) Notice: Subject to any disclaimer, the term of this patent is extended or adjusted under 35 U.S.C. 154(b) by 0 days.

(21) Appl. No.: 10/290,602

(22) Filed: Nov. 7, 2002

(51) Int. Cl.[7] ..... E02B 13/00
(52) U.S. Cl. ..... 405/48; 52/11; 404/2
(58) Field of Search ..... 405/118, 119, 405/43, 47, 48; 404/2–4; 52/11, 12

(56) References Cited

U.S. PATENT DOCUMENTS 5,106,231 A * 4/1992 Thomann ..... 405/119
5,564,860 A * 10/1996 Amann ..... 405/118
5,890,839 A * 4/1999 Gunter ..... 405/119
6,314,684 B1 * 11/2001 Aviram ..... 52/11
6,442,904 B1 * 9/2002 Ortiz ..... 52/11
6,443,656 B1 * 9/2002 Gunter ..... 405/119

* cited by examiner

*Primary Examiner*—Robert E. Pezzuto
*Assistant Examiner*—Tara L. Mayo
(74) *Attorney, Agent, or Firm*—Robert E. Howard

(57) ABSTRACT

A trench cover for temporarily covering a trench and a rail member used in constructing the trench cover. The cover includes a pair of longitudinally extending rails, the rails being spaced apart and substantially parallel to each other. Each rail includes a web extending between an upper flange and a lower lip. The flange, web and lip form a C-shaped channel. The C-shaped channels of the cover's pair of rails face each other. A substantially flat cover member having longitudinally extending side edges is positioned within the C-shaped channels of the rails and attached to the rails.

12 Claims, 2 Drawing Sheets

TEMPORARY TRENCH COVER AND RAIL

BACKGROUND OF THE INVENTION

The present invention relates to a temporary trench cover for use during construction and a rail member used in forming the trench cover.

During construction of a building, or in retrofitting an existing building, it is often necessary to cut a trench through a concrete slab, and into the underlayment, for placement of pipes or electrical wiring. Such trenches must be accessible for the period of time required to complete the laying of the pipe or wiring. For safety reasons, temporary covers must be placed over the trench opening during the period of time they are not being accessed so that workers or the public at the construction site will not inadvertently step into the trench, thereby causing them to fall and become injured.

It is typical at such sites to temporarily cover a trench with a steel plate. However, such plates are expensive, are heavy and difficult to handle, and have edges extending above floor level which can cause a person to trip and fall. p It has also been suggested to anchor 2" by 4" wooden blocks to the entire inside upper edge of a trench and nail or screw one inch thick plywood strips to the tops of the blocks. Although the blocks can be positioned so that the upper surface of the plywood is level with the floor surface to eliminate tripping, such a system is very time consuming to construct, hard to remove, and access to the trench is costly and narrows the width of the trench by about three inches. In addition, since the blocks are typically anchored about four feet apart, the system is not very strong.

SUMMARY OF THE INVENTION

It is an object of the present invention to provide a temporary trench cover for relatively narrow trenches, i.e., up to about 48 inches in width, that reduces or eliminates the problems encountered with many prior temporary trench covers.

The temporary trench cover of the present invention includes a pair of longitudinally extending rails, the rails being spaced apart and substantially parallel to each other. Each rail includes a web extending between an upper flange and a lower lip. The flange, web and lip form a C-shaped channel. The C-shaped channels of the cover's pair of rails face each other. A substantially flat cover member having longitudinally extending edges is positioned within the C-shaped channels of the rails and is attached to the rails.

DESCRIPTION OF PREFERRED EMBODIMENTS

The temporary trench cover 10 includes a pair of identical longitudinally extending rail members 20 and flat cover member 30. Rail members 20 can be made in any length or various lengths; it is preferred to provide rail members 20 in lengths of eight feet each.

Figure 3:
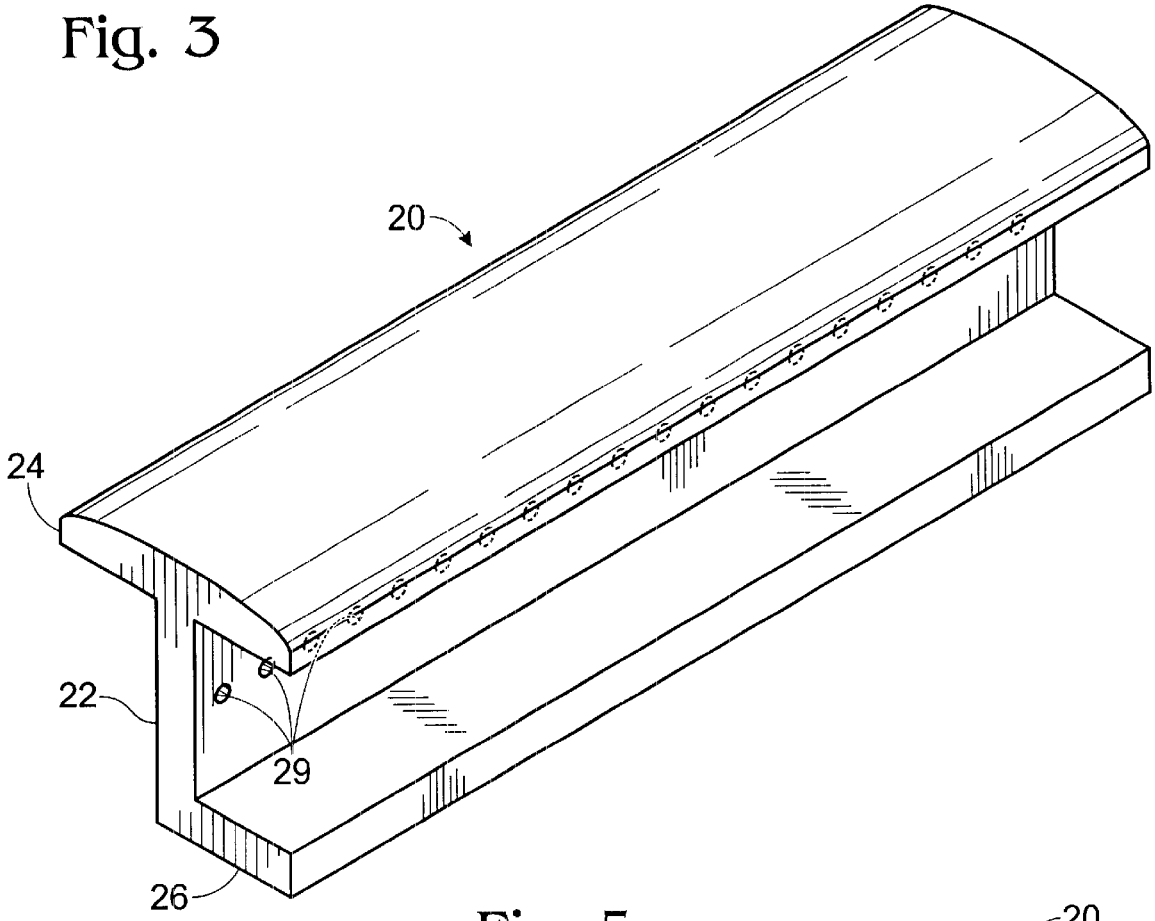
FIG. 3 is a front perspective view of the rail member of the temporary trench cover of the present invention.
Figure 5:
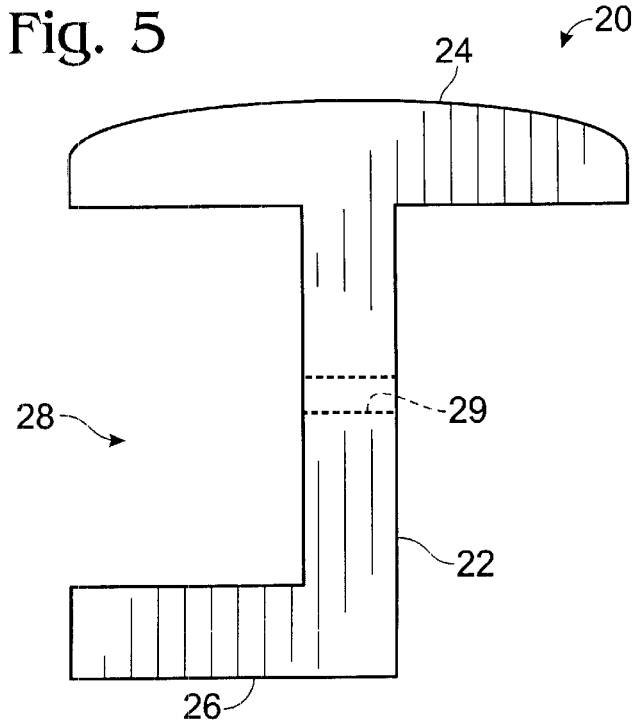
FIG. 5 is an end elevation view of the rail member of the temporary trench cover of the present invention.

Each rail member 20 includes a web 22, an upper flange 24 and, an outwardly projecting lower lip 26. The planes of flange 24 and lip 26 are substantially perpendicular to the plane of web 22, and substantially parallel to each other. Web 22 and upper flange 24 form a T-shaped member. Web 22 and lip 26 form an L-shaped member (as seen in FIG. 3). Web 22, flange 24 and lip 26 are integral, and rail member 20 is preferably formed by the continuous extrusion of metal or plastic.

Flange 24 extends outwardly from web 22 a substantially equal distance in both directions, the distance being substantially equal to the distance lip 26 extends outwardly from web 22. The upper surface of flange 24 is arcuate in shape. The bottom surface of flange 24 is substantially flat, and that portion of flange 24 extending outwardly over lip 26 together with web 22 and lip 26 form a C-shaped channel 28. The height of C-shaped channel 28 is such as to accommodate the thickness of cover member 30. The thickness of cover member 30 is preferably between about ¾ inch and about one inch.

Although not intended to be limiting, a preferred width for flange 24 is about two inches, and a preferred thickness for web 22 and lip 26 is about 3/16 inch.

Web 22 has a plurality of fastener receiving holes 29 extending therethrough.

Figure 1:
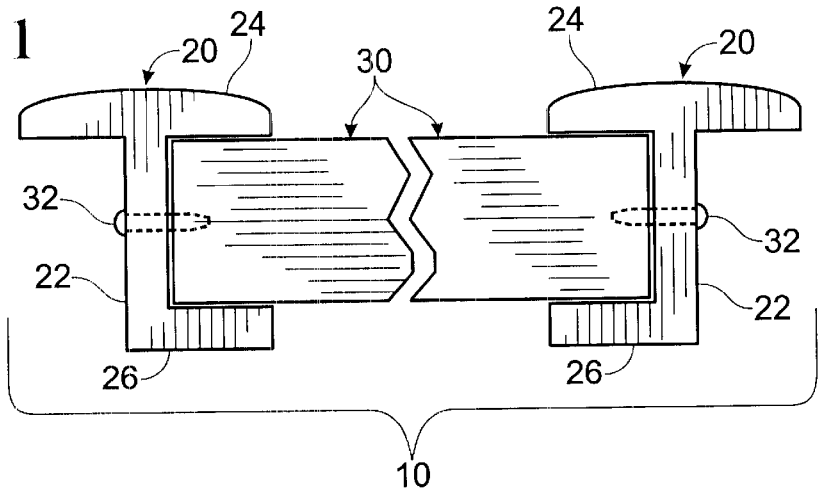
FIG. 1 is an end elevation view of the temporary trench cover of the present invention.
Figure 2:
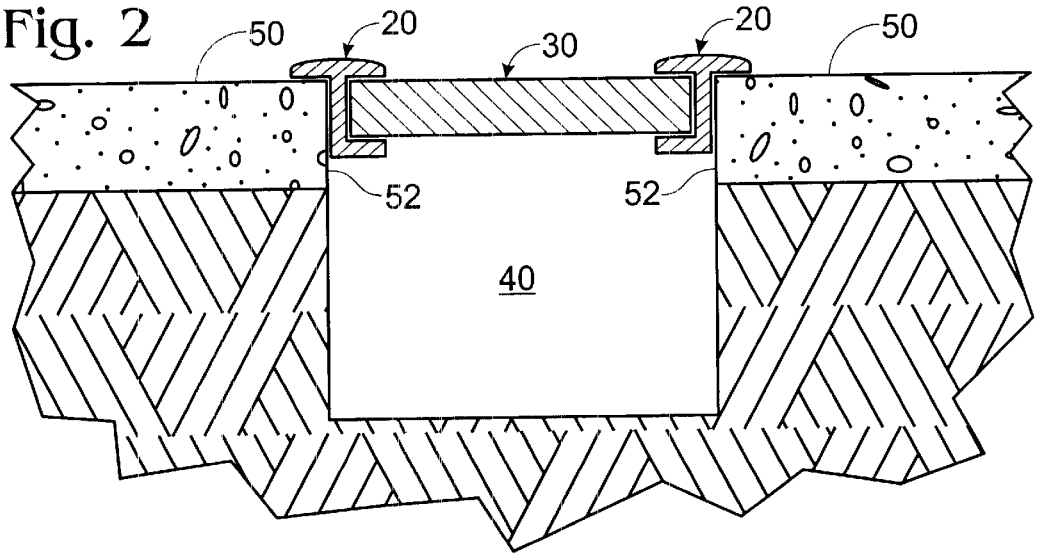
FIG. 2 is an end elevation view of the temporary trench cover of the present invention shown covering a trench opening.
Figure 4:
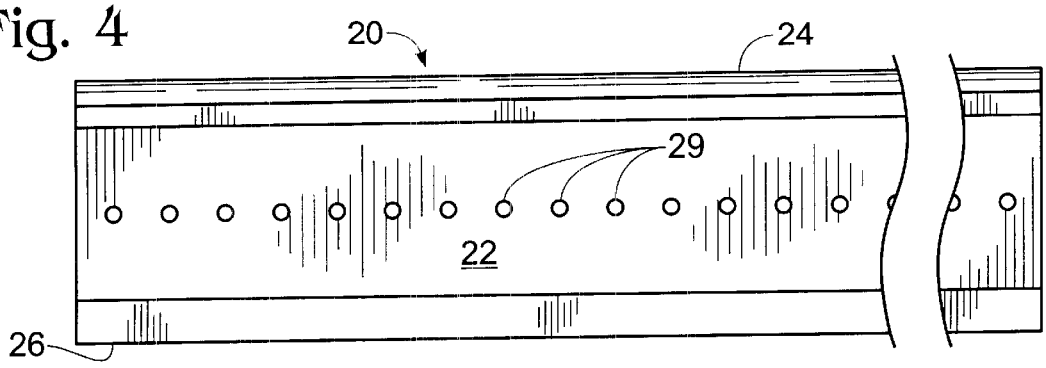
FIG. 4 is a front elevation view of the rail member of the temporary trench cover of the present invention.

The temporary trench cover 10 includes a pair of substantially parallel rails 20 whose C-shaped channels 28 face each other, as seen in FIGS. 1 and 2.

The longitudinally extending edges of a cover member 30 are inserted into the C-shaped channels 28 and fastened thereto by fastening members 32 passing through holes 29 in rails 20. Where cover member 30 is plywood or wood, fastening members 32 may, for example, be nails or screws. Although fastening members 32 are shown in FIG. 1 as having a head extending outwardly from the outer surface of web 22, holes 29 can be configured so that the heads would be completely recessed within the outer surface of web 22.

The width of cover member 30 is selected so that, together with the thickness of webs 22, the temporary trench cover 10 will extend across the width of a trench to be covered. Temporary trench cover 10 is intended for use primarily with relatively narrow trenches, i.e., having a width up to about 48 inches.

Cover member 30 is preferably made of plywood because of its relatively light weight and good strength characteristics. The thickness of the plywood used for cover member 30 is preferably about ¾ inch for relatively narrow trenches (up to about 18 inches in width) or about 1 inch for wider trenches (from about 18 inches up to about 48 inches).

FIG. 2 shows the temporary trench cover 10 covering a trench 40 cut through a concrete slab 50 and its underlayment. The outer surfaces of webs 22 abut against the edges 52 of the slab 50 with the outer bottom surfaces of upper flanges 22 in abutment with the upper surface of the slab 50 adjacent edges 52 thereof. As can be seen, temporary trench cover 10 merely rests unattached within trench 40, and can be easily and quickly inserted therein and removed therefrom.

The top surface of upper flange 22 has an arcuate shape, as shown, so that persons passing thereover are not presented with an edge that can cause tripping. The outer longitudinal edges of flange 22 can be very thin, preferably about 1/16 inch, with the middle of flange 22 (i.e., its crown) having a thickness of about 3/16 inch (the same thickness as web 22 and lip 26).

A plurality of trench covers 10 would be placed end to end along the length of a trench 40. The rails 20 and cover 30 of an end trench cover 10 can be easily cut to the length required to fit the length of the end of a trench 40.

It will be obvious to those having skill in the art that many changes may be made to the details of the above-described embodiments of this invention without departing from the underlying principles thereof. The scope of the present invention should, therefore, be determined only by the following claims.

The invention claimed is:

1. A trench cover for temporarily covering a trench comprising:

a pair of longitudinally extending rails having substantially identical predetermined lengths, each said rail including a web extending between an upper flange and a lower lip, said flange having an upper and lower surface, said web intersecting the lower surface of said upper flange at its mid-portion to thereby form a T-shaped member, said lower lip extending outwardly from said web, said web and said lower lip forming an L-shaped member, that portion of said upper flange extending outwardly over said lower lip, said web and said lower lip forming a C-shaped channel, the lower surface of that portion of said upper flange not extending outwardly over said lower lip adapted to abut the upper surface of said trench adjacent the edge thereof;

said pair of rails being spaced apart and substantially parallel to each other with the C-shaped channels of each of said rails facing each other; and a substantially flat cover member having a length, width and thickness, said cover member having longitudinally extending side edges positioned within said C-shaped channels of each of said rail.

2. The trench cover of claim 1 wherein said flange has an arcuate upper surface and a substantially flat lower surface.

3. The trench cover of claim 1 wherein said rail members have a length of about eight feet.

4. The trench cover of claim 1 wherein said cover member is formed of plywood.

5. The trench cover of claim 1 wherein the distance between said upper flange and said lower lip of said C-shaped channels of said rails is substantially the thickness of said cover member.

6. The trench cover of claim 1 wherein the distance between said upper flange and said lower lip of said C-shaped channels of said rails is between about 0.75 inch and about 1.0 inch.

7. A trench cover for temporarily covering a trench comprising:

a pair of longitudinally extending rails having substantially identical predetermined lengths, each said rail including a web extending between an upper flange and a lower lip, said web and said upper flange forming a T-shaped member, said lower lip extending outwardly from said web, said web and said lower lip forming an L-shaped member, said upper flange, web and lower lip forming a C-shaped channel;

said pair of rails being spaced apart and substantially parallel to each other with the C-shaped channels of each of said rails facing each other; and a substantially flat cover member having a length, width and thickness, said cover member having longitudinally extending side edges positioned within said C-shaped channels of each of said rails;

each of said webs having a plurality of fastener receiving openings extending therethrough, and a plurality of fasteners extending through said fastener receiving openings into fastening engagement with said cover member.

8. A rail member for use in constructing a trench cover, said rail member comprising a web extending between an upper flange and a lower lip, said flange having an upper and lower surface, said web intersecting the lower surface of said upper flange at its mid-portion to thereby form a T-shaped member, said lower lip extending outwardly from said web, said web and said lower lip forming an L-shaped member, that portion of said upper flange extending outwardly over said lower lip, said web and said lower lip forming a C-shaped channel, the lower surface of that portion of said upper flange not extending outwardly over said lower lip adapted to abut the upper surface of said trench adjacent the edge thereof.

9. The rail member of claim 8 wherein said flange has an arcuate upper surface and a substantially flat lower surface.

10. The rail member of claim 8 wherein said rail member has a length of about eight feet.

11. The rail member of claim 8 wherein the distance between said upper flange and said lower lip of said C-shaped channels of said rails is between about 0.75 inch and about 1.0 inch.

12. A rail member for use in constructing a trench cover, said rail member comprising a web extending between an upper flange and a lower lip, said web and said upper flange forming a T-shaped member, said lower lip extending outwardly from said web, said web and said lower lip forming an L-shaped member, said upper flange, web and lower lip forming a C-shaped channel, said web as having a plurality of fastener receiving openings extending therethrough.

* * * * *